US007850027B2

(12) United States Patent
Hayes et al.

(10) Patent No.: US 7,850,027 B2
(45) Date of Patent: Dec. 14, 2010

(54) QUICK MIXING BABY FORMULA CYLINDER

(75) Inventors: Scott H. Hayes, Mooresville, NC (US); Scarlet L. Hayes, Mooresville, NC (US)

(73) Assignee: Lacy Enterprise, Inc., Mooresville, NC (US)

( * ) Notice: Subject to any disclaimer, the term of this patent is extended or adjusted under 35 U.S.C. 154(b) by 808 days.

(21) Appl. No.: 11/714,575

(22) Filed: Mar. 6, 2007

(65) Prior Publication Data

US 2007/0284329 A1 Dec. 13, 2007

Related U.S. Application Data

(60) Provisional application No. 60/811,970, filed on Jun. 8, 2006.

(51) Int. Cl.
*A61J 11/00* (2006.01)
*A61J 9/00* (2006.01)

(52) U.S. Cl. ..... 215/11.4; 215/DIG. 8; 206/219

(58) Field of Classification Search ..... 215/11.4, 215/313, DIG. 8; 206/221, 219, 222
See application file for complete search history.

(56) References Cited

U.S. PATENT DOCUMENTS 2,977,015 A * 3/1961 Bartlett ..... 215/313
4,779,722 A * 10/1988 Hall ..... 206/221
4,979,629 A * 12/1990 Askerneese ..... 215/11.1
5,275,298 A 1/1994 Holley, Jr. et al.
5,419,445 A 5/1995 Kaesemeyer
5,634,714 A 6/1997 Guild
5,794,802 A 8/1998 Caola
5,863,126 A 1/1999 Guild
5,875,888 A 3/1999 Albisetti
5,890,627 A 4/1999 Storey
6,045,254 A 4/2000 Inbar et al.
6,113,257 A 9/2000 Sharon et al.
6,257,428 B1 7/2001 Caola
6,705,491 B1 * 3/2004 Lizerbram et al. ..... 222/145.1
6,945,393 B2 * 9/2005 Cho ..... 206/219
7,055,685 B1 6/2006 Patterson et al.
7,150,369 B1 * 12/2006 Fryar ..... 215/11.4
7,331,478 B2 * 2/2008 Aljadi ..... 215/11.4
7,464,811 B2 12/2008 Patterson et al.
7,484,633 B1 2/2009 Moher
2009/0178940 A1 * 7/2009 Said ..... 206/221

OTHER PUBLICATIONS

Umix Travel Bottle, www.umix.com, date unknown, believed to be available as of filing date.

* cited by examiner

*Primary Examiner*—Sue A Weaver
(74) *Attorney, Agent, or Firm*—Womble Carlyle Sandridge & Rice, PLLC

(57) ABSTRACT

Baby-bottle attachment for holding dry formula separated from water in bottle has a bottom portion with internal bottle-mating threads that mate to a threaded top on a baby bottle. The attachment includes a partition having an aperture and a seal on its upper surface. The bottom portion has channels partially imbedded therein. An upper chamber has external threads that mate with a nipple. The upper chamber has a partially open bottom with an off-center aperture. A seal pad is adhered underneath the at least partially open bottom of the upper chamber. A top member has a depressible release button that extends from the end, and is attached to outer surface near the bottom of the upper chamber.

13 Claims, 4 Drawing Sheets

QUICK MIXING BABY FORMULA CYLINDER

CROSS REFERENCE TO RELATED APPLICATION

This patent application is related to and claims priority from U.S. Provisional Patent Application Ser. No. 60/811,970 filed Jun. 8, 2006.

FIELD OF THE INVENTION

The present invention relates, in general, to baby formula bottles and, more particularly, this invention relates to an improved method for transporting and quickly mixing dry formula and water in the proper ratio to prepare a ready-to-drink bottle in travel situations.

BACKGROUND OF THE INVENTION

Prior to the conception and development of the present invention, powder baby formula is typically measured in proper ratio to the amount of water in the bottle and then immediately added to the water and mixed just minutes prior to consumption. This approach presents no difficulty at home, but it does impose an inconvenience to the parents or caregivers while traveling. In fact, use of liquid formulas is more prevalent at home. Infants require frequent feeding and liquid formula bottles or milk require refrigeration to prevent spoilage, and heating is required prior to consumption. While the refrigeration and heating can be avoided by blending a powder and water just prior to consumption, this poses an inconvenience and potentially messy situation while traveling.

Numerous, somewhat elaborate, devices have been disclosed for storing a formula powder within a bottle until just prior to consumption, with provisions for rapidly combining and mixing the liquid and powder without opening the bottle. Some represent a whole new bottle design while others are made to fit into a standard bottle arrangement.

For example, in U.S. Pat. No. 5,419,445, Kaesemeyer teaches the design of holding the formula powder in a cartridge inside a baby bottle with the water stored in the bottle below.

In U.S. Pat. No. 5,794,802, Caola teaches a reusable insert designed for standard baby bottles to keep the formula powder and water separate until a push rod forces a chamber seal into the water portion of the bottle. Activation in this case involves the unsanitary act of pushing on the nipple.

In U.S. Pat. No. 5,634,714 to Guild, a long-stemmed disk is dislodged and falls into the liquid allowing the powder to mix with the water.

One common and significant feature of these three examples and others is that a portion of the sealing mechanism is pushed into the lower water compartment at the time of mixing, and it must be retrieved and reassembled later. Thus, it appears that there is a need for a moderately-priced convenience device that fits standard bottle/nipple combinations, yet avoids the retrieval and reassembly tasks.

SUMMARY OF THE INVENTION

A cylindrical baby-bottle attachment for holding dry feeding formula separate from water in the bottle having a cylindrical bottom part that has at least one U-shaped recess in the top rim and includes internal bottle-mating threads at a lower first totally open end sized to mate to a threaded top on a common baby bottle. A midsection partition covers at least half of the cylinder cross sectional area. This partition has an orifice at the center axis for a bolt and also has a rubber-like seal pad adhered to a solid portion of its upper surface. There are channels partially imbedded around a substantial portion of the upper inner circumference of such bottom part. Further, there is an upper cup-like chamber having a totally open top end with external threads sized to accommodate a common nipple assembly further having a flanged partially open bottom end with an off-center aperture. The aperture has a cross sectional area about 0.2 to 0.5 that of the total cross sectional area and there is a seal pad adhered underneath a solid portion of the partially open bottom end which has a cross sectional area at least as great as that of the apertures. The top member further has at least one outward-facing depressible release button attached to the distal end of a rectangular strip parallel to its bottom flange and extending tangentially from proximal end attached to outer surface near the bottom of the upper cup-like chamber. The final essential element is a bolt and matching wing nut assembly with the bolt fused to the bottom floor and the wing nut further having a sealing washer attached to a flat surface on one side of such wing nut. The present invention provides a convenient and economical device for storing and subsequently mixing a pre-measured amount of baby formula powder with water in a feeding bottle. It is especially convenient for times when traveling with an infant.

OBJECTS OF THE INVENTION

It is, therefore, one of the primary objects of the present invention to provide a convenient and economical device that will simplify transportation and eventual mixing of powdered infant formula with water just prior to consumption.

Another object of the present invention is to provide an attachment fitting many current commercial bottles and nipples such that the parents will have an economical total unit without replacing their current bottle supply.

An additional object of this invention is to provide a infant bottle attachment that is reusable without retrieving parts and putting them back together.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 2:
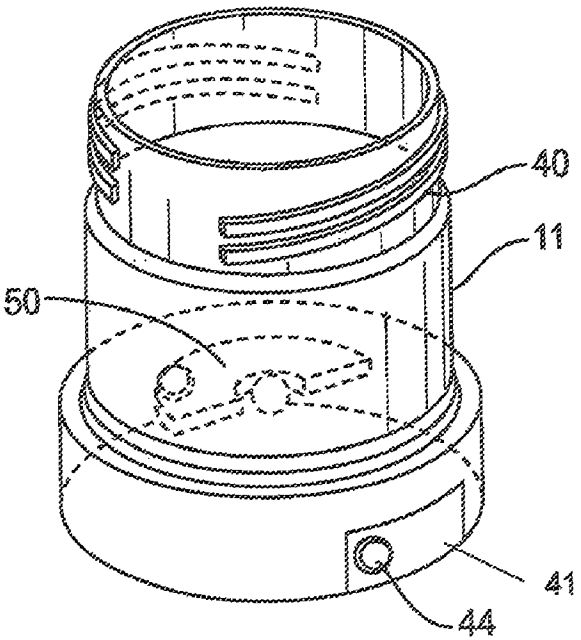
FIG. 2 is a perspective view of the upper chamber of the cylinder attachment.

DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 1:
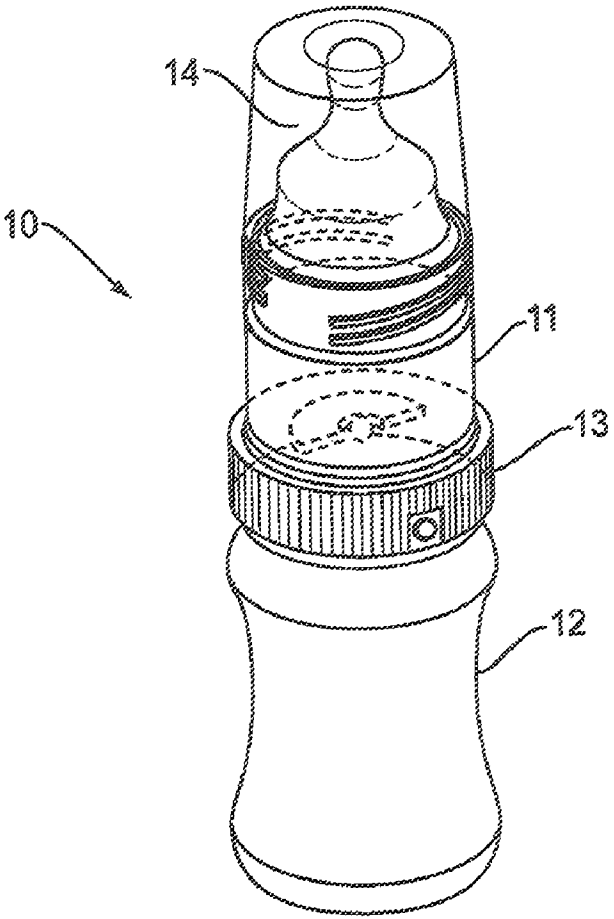
FIG. 1 is an overview of an infant feeding bottle unit with the cylinder invention assembled between the bottle and nipple.

Referring initially to FIG. 1, a bottle and formula cylinder arrangement, generally designated 10, is shown with a cylinder 11 attached to a standard baby bottle 12 below via the lower ring 13, and also attached to a standard nipple and cover assembly 14 above. As shown in FIG. 2 the upper cylinder 11 includes the upper aperture 50, the release button 44, and the nipple mating threads 40. The bottom ring 13 has first height between about 0.5 and 2.0 inches and a first diameter between about 1.5 and 3.0 inches.

Figure 3:
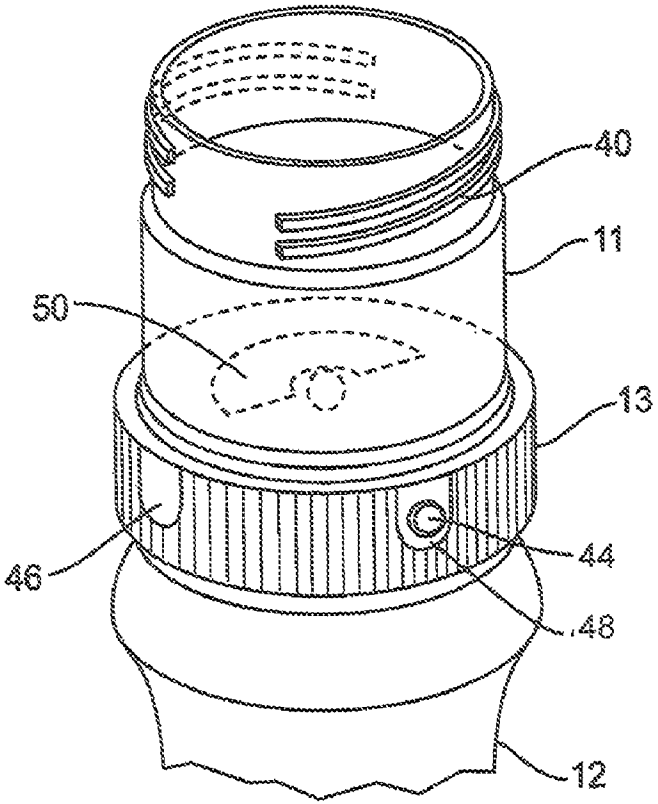
FIG. 3 is a perspective view of the upper chamber being held by a lower mounting ring to the top of a standard plastic baby bottle.

Referring to FIG. 3, the preferred embodiment of the invention is depicted mounted on the top of a standard baby bottle 12. A cylindrical chamber 11 holds and keeps the powder dry until a release button 44 is depressed by the "Closed" notch 46 in bottom ring 13. The release button 44 is attached to the distal end of a rectangular strip 41. The strip 41 extends tangentially from the surface of the upper chamber 11. The depressed button allows the cylinder 11 to be rotated to the "Open" position 44, whereupon button 44 is released and extends into the U-shaped recess 48. This rotation aligns the aperture 50 with an aperture of similar size and shape in a horizontal partition 58 (58 not shown in FIG. 3) across the open area of a ring 13. Mating threads 40 are available for screwing on a standard nipple assembly. The upper cylindrical chamber 11 has second height between about 2.0 and 4.0 inches.

Figure 4:
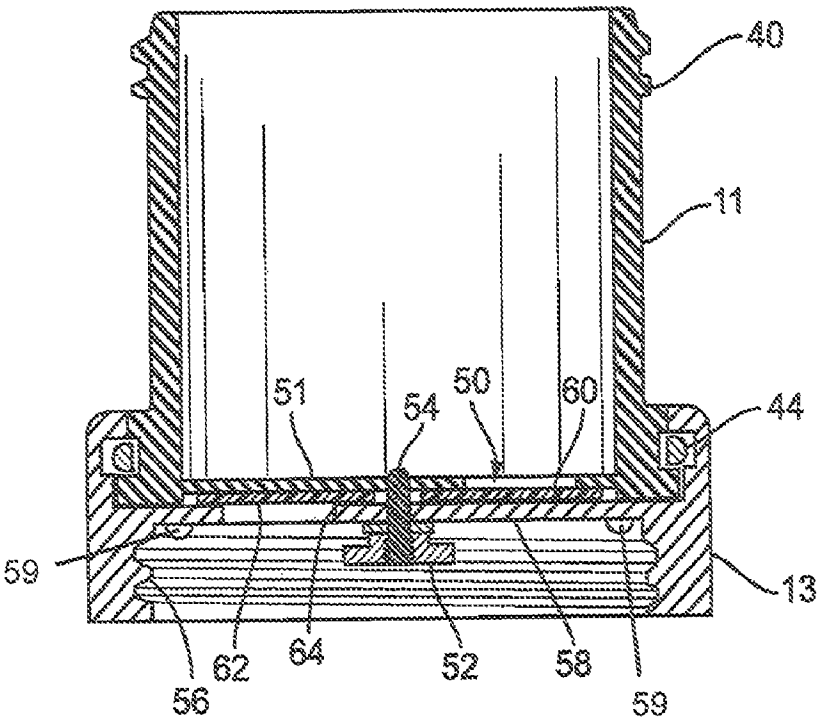
FIG. 4 is an elevation sectional view of the formula cylinder apparatus.

FIG. 4 provides a vertical sectional view of a two-button version of the presently preferred embodiment with additional construction details. The upper chamber 11 is connected to the bottom ring 13 by the combination of a bolt 54 fused to the bottom 51 at the central axis and a nut 52 screwed onto bolt 54 beneath the horizontal partition 58 that is integral to ring 13. There are comparable apertures 50 in the bottom floor 51 and 64 in the horizontal partition 58. When in the "Closed" position, the two apertures are sealed by rubber like pads 60 and 62 of slightly larger size adhered to a surface of the opposing partitions, 58 and 51 respectively. A sealing gasket 59 attached to the underside of said midsection partition 58 adjacent a proximal end of said bottle mating threads.

Figure 5:
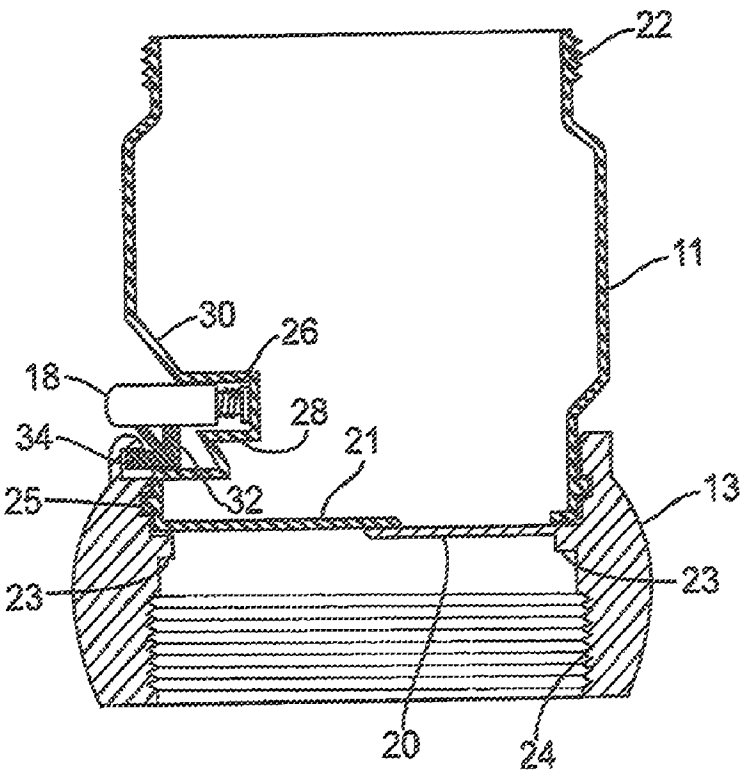
FIG. 5 is an elevation sectional view of a second embodiment of the invention.

FIG. 5 is a vertical sectional view of a second embodiment cutting through the release button 18 longitudinally, and showing both the upper cylinder 11 with its nipple mating threads 22, and the lower attachment ring 13. Above the bottle mating threads 24, the lower ring 13 has a built-in horizontal member 20 that covers about half of the cross-sectional area defined by the inside diameter of ring 13. Also built into the upper inside surface of attachment ring 13 are a circumferential ledge 23, circumferential groove 25, and a cavity 34. Release button 18 has an attached leg 32 that engages with cavity 34. Also attached to button 18 is a spring 26 that fits into the cavity 28 molded into recessed area 30 of the upper cylinder 11. The upper cylinder 11 has a floor 21 across slightly more than half of the bottom area. For example, the first height of said hoop-like bottom part is between about 0.75 to 2.0 inches, and the first outside diameter is between about 2.0 and 3.5 inches.

Figure 6:
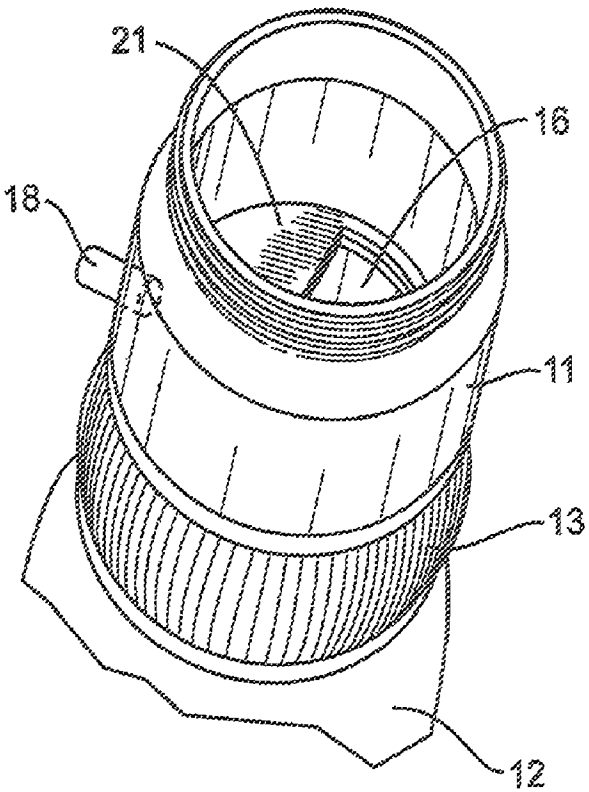
FIG. 6 is a perspective view of the second embodiment of the invention.

FIG. 6 is a perspective view from above with the two apertures aligned to create an opening 16. When the user desires to blend the formula powder stored in cylinder 11 with the water in the bottle 12, the release button 18 is depressed and held in while rotating the upper cylinder 11 approximately 180 degrees until the floor 21 is in position to create the opening 16 that will readily allow the powder to drop and be mixed with the water. The opening 16 remains while the prepared formula is fed to the infant.

An upper chamber has a second height, a second central diameter, and a third base diameter. The upper chamber 11 is sized to accommodate a baby bottle nipple assembly.

The second height is between about 2.0 inches and 4.0 inches, the second central diameter of said upper chamber is between about 2.0 and 3.5 inches, and the third base diameter of said upper chamber is between about 1.5 and 3.5 inches.

A cylindrical bottom part has a first height between about 0.75 and 2.0 inches.

Figure 7:
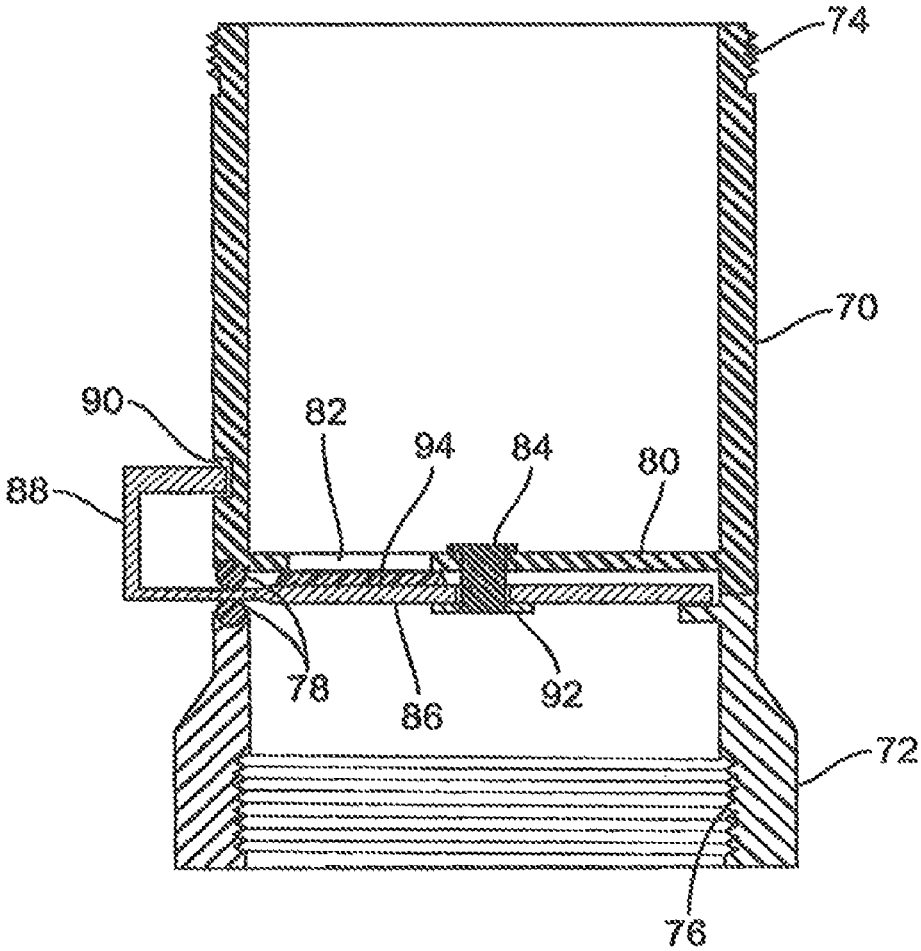
FIG. 7 is an elevation sectional view of a third embodiment of the invention.

A third embodiment of the invention is shown in FIG. 7. The upper cylindrical chamber 70 having external threads 74 adjacent the top end for mating to a standard baby bottle nipple, is fused at three-quarters of its bottom periphery, to lower ring 72, which has internal threads 76 to mate to a standard baby bottle. The other one quarter of the bottom edge of cylindrical chamber 70 abuts the top edge of ring 72. Rubber-like partial 0-rings 78 are imbedded in the edge such that the two partial 0-rings 78 are tightly compressed against one another. The cylindrical chamber 70, has a bottom floor 80 with a sizeable off-center aperture 82 and a central fused-in pin 84. An upper cylindrical chamber also has a second height between about 2.0 and 4.0 inches.

Suspended just below the bottom floor 80 is a rotatable horizontal disc 86 with a central orifice slightly larger than the outer diameter of central pin 84. Adhered to the top surface of disc 86 is a rubber-like seal pad 94 covering an area slightly larger than that of aperture 82. Horizontal disc 86 is held in place on central pin 84 by a fused on washer 92 such that disc 86 is still free to rotate while seal pad 94 is held against the underside of floor 80 sufficiently to prevent water leakage past it. Disc 86 also has an off-center aperture comparable in size and shape to aperture 82, and this aperture in disc 86 is centered about 90 degrees from seal pad 94.

A substantially U-shaped tab 88 is fused at one location on the periphery of disc 86 and extends outward between O-rings 78 with the distal end engaging one of two notches 90 built into the outer surface of cylindrical chamber 70. When in the closed position, seal pad 94 covers the floor aperture 82 and disc 86 is prevented from rotating by tab 88 engaged in a notch 90.

When the user wishes to mix the two ingredients, the tab 88 is pulled back to release it from the "Closed" notch, and tab 88 is then slid about 90 degrees and released into the "Open" notch. This aligns the two apertures and allows the powder to drop into the water and be mixed by shaking. The "Open" position is maintained for feeding the baby.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

We claim:

1. A cylindrical-baby-bottle attachment comprising:

(a) a cylindrical bottom with a first outside diameter and a first height defining a lower open end and an upper open end, said upper open end defining a first cross sectional area including:

(i) internal bottle-mating threads at said lower open end sized to mate to a threaded top on a baby bottle;

(ii) a horizontal midsection partition perpendicular to an inside wall of said cylindrical bottom above said internal bottle-mating threads and covering at least half of said first cross sectional area;

(iii) a seal pad adhered to a portion of the upper surface of said midsection partition, said midsection partition further having an orifice at the center axis for a bolt;

(iv) channels partially imbedded around a substantial portion of an upper inner circumference of said cylindrical bottom;

(v) at least one U-shaped recess in a top rim of said cylindrical bottom; and (b) an upper chamber with each of a second height and a second cross sectional area including:

(i) at least a partially open bottom end with an aperture having a third cross sectional area about 0.2 to 0.5 that of said second cross sectional area;

(ii) an open top end, said open top end having external threads sized to accommodate a nipple assembly;

(iii) a second seal pad adhered underneath a portion of said at least partially open bottom end and having a fourth cross sectional area at least as great as that of said third cross sectional area;

(iv) at least one depressible release button attached to a distal end of a rectangular strip that extends from the outer surface of said upper chamber;

(c) a bolt and nut assembly, said bolt on said bottom of said at least partially open bottom end, said nut further having a sealing washer nut; and (d) a sealing gasket attached to the underside of said midsection partition adjacent a proximal end of said bottle mating threads.

2. A cylindrical baby bottle attachment of claim 1, wherein said first diameter of said cylindrical bottom is between about 1.5 and 3.0 inches.

3. A cylindrical baby bottle attachment of claim 1, wherein said first height of said cylindrical bottom is between about 0.5 and 2.0 inches.

4. A cylindrical baby bottle attachment of claim 1, wherein said second height of said upper chamber is between about 2.0 and 4.0 inches.

5. A cylindrical baby-bottle attachment comprising:

(a) a hoop-like bottom having a first height and a first outer diameter defining an at least partially open top end and an open lower end, said open lower end having internal threads sized to mate to a threaded top on a baby bottle, said at least partially open end has at least one mating cavity within an uppermost internal surface and a groove formed around an upper inner circumference beneath said cavity, said at least partially open end further has an internal flange protruding toward a center axis extending along at least half of the upper inner circumference; and (b) an upper chamber having a second height, a second central diameter and a third base diameter including:

(i) a lower at least partially-open end and an open top end, said open end having external threads sized to accommodate a baby bottle nipple assembly;

(ii) a semi-circular aperture having an open area about one-third to about half that of the entire cross section of said at least partially open end;

(iii) at least one beveled recessed zone proximal said at least partially open end; and (iv) a cavity within each of the at least one beveled recessed zone extending radially toward the central axis; and (c) at least one spring-loaded release button assembly positioned in each of the at least one beveled recessed zone of said upper chamber, wherein each of said release buttons has an L-shaped foot engaging with each of said cavities in said hoop-like bottom.

6. A baby-bottle attachment of claim 5, wherein said first height of said hoop-like bottom is between about 0.75 to 2.0 inches.

7. A baby-bottle attachment of claim 5, wherein 10 said first outside diameter of said hoop-like bottom is between about 2.0 and 3.5 inches.

8. A baby-bottle attachment of claim 5, wherein said second height of said upper chamber is between about 2.0 inches and 4.0 inches.

9. A baby-bottle attachment of claim 5, wherein said second central diameter of said upper chamber is between about 2.0 and 3.5 inches.

10. A baby-bottle attachment of claim 5, wherein said third base diameter of said upper chamber is between about 1.5 and 3.5 inches.

11. A cylindrical baby-bottle attachment comprising:

(a) a cylindrical bottom defining two substantially open ends with a first height, wherein a lower of said two substantially open ends contains internal threads sized to mate with a baby bottle;

(b) a first at least partial 0-ring embedded in about one-quarter of a top rim, (c) an upper cylindrical chamber with a second height, an open upper end and an at least partially open floor, including:

(i) external threads at top of said open end sized to mate with a baby bottle nipple assembly, (ii) a downward-projecting pin at a center axis of the upper chamber fused to said at least a partially open floor, (iii) an aperture in said at least partially open floor creating an open area between about one-fifth to half that of total area of said at least partially open floor, (iv) a second at least partial 0-ring embedded along about one quarter of a bottom rim of said upper cylindrical chamber, (d) a rotatable horizontal disc suspended beneath said at least partially open floor of said upper cylindrical chamber, including:

(i) a seal pad adhered to an upper surface of said rotatable disc and having a similar shape to said aperture in said at least partially open floor of said upper cylindrical chamber;

(ii) an aperture comparable in area and shape to that of said aperture in said at least partially open floor, (iii) a central orifice with a greater diameter than that of said downward projecting pin, and (e) a washer on the lower end of said downward-projecting pin beneath said rotatable disc.

12. A cylindrical baby bottle attachment of claim 11, wherein said first height of said cylindrical bottom is between about 0.75 and 2.0 inches.

13. A cylindrical baby bottle attachment of claim 11, wherein said second height of said upper cylindrical chamber is between about 2.0 and 4.0 inches.

* * * * *